United States Patent [19]

De Marco

[11] Patent Number: 4,872,250

[45] Date of Patent: Oct. 10, 1989

[54] METHOD FOR FABRICATING A DISHED HOLLOW BODY POSSESSING A LINEAR OR HELICAL INNER TOOTHING

[75] Inventor: Franco De Marco, Jona, Switzerland

[73] Assignee: Ernst Grob AG, Männedorf, Switzerland

[21] Appl. No.: 97,749

[22] Filed: Sep. 17, 1987

[30] Foreign Application Priority Data

Sep. 18, 1986 [CH] Switzerland ..... 03747/86

[51] Int. Cl.[4] ..... B21D 19/00

[52] U.S. Cl. ..... 29/159.2; 72/96; 72/100; 72/193

[58] Field of Search ..... 29/159.2; 72/95, 96, 72/100, 191, 192, 193

[56] References Cited

U.S. PATENT DOCUMENTS

| | | | |
|---|---|---|---|
| 3,407,638 | 10/1968 | Greis et al. | 72/193 |
| 3,473,211 | 10/1969 | Lindell | 72/106 |
| 3,543,553 | 4/1968 | Marcovitch | 72/100 |
| 3,735,618 | 5/1973 | Zook | 72/100 |
| 3,753,365 | 8/1973 | Kralowetz | 72/76 |
| 4,094,183 | 6/1978 | Mettler | 72/356 |
| 4,116,032 | 9/1978 | Krapfenbauer et al. | 72/100 |

*Primary Examiner*—Bruce Y. Arnold
*Assistant Examiner*—R. D. Shafer
*Attorney, Agent, or Firm*—Werner W. Kleeman

[57] ABSTRACT

According to the well known Grob method, there is fabricated on a mandrel provided with outer or external toothing or teeth a substantially dished or pot-shaped hollow body with corresponding inner or internal toothing or teeth. This fabrication operation starts with a blank comprising an at least partial web portion or dish base and a rim portion or dish rim projecting in a substantially tube-like or tubular configuration from the web portion or dish base. As seen in longitudinal section, this blank possesses a rounded or arcuate portion in the transition region or zone between the rim portion or dish rim and the web portion or dish base. This rounded or arcuate portion has a mean radius of curvature which is at least as large as the wall thickness of the rim portion or dish rim of the blank.

11 Claims, 4 Drawing Sheets

METHOD FOR FABRICATING A DISHED HOLLOW BODY POSSESSING A LINEAR OR HELICAL INNER TOOTHING

CROSS-REFERENCE TO RELATED APPLICATIONS

This application is related to the commonly assigned, copending U.S. application Ser. No. 07/075,123, filed July 20, 1987, and entitled "METHOD 0F FABRICATING A RIM GEAR, SUCH AS A STARTER RIM GEAR MADE 0F SHEET METAL AND RIM GEAR PRODUCED THEREBY" now U.S. Pat. No. 4,796,345, granted Jan. 10, 1989 and that this application is further related to the commonly assigned, copending U.S. application Ser. No. 07/008,766, filed Jan. 30, 1987, and entitled "METHOD OF, AND APPARATUS FOR, COLD FORMING HELICAL TOOTHING", now abandoned.

BACKGROUND OF THE INVENTION

The present invention broadly relates to a new and improved method for fabricating a substantially dished or pot-shaped hollow body possessing straight or helical inner or internal toothing or teeth. The method is especially well suited, although not exclusively, for the fabrication of internal geared wheels or gears for use in planetary gear trains or system.

Generally speaking, the method of the present invention for fabricating from a blank of a workpiece a substantially dished or pot-shaped hollow body possessing straight or helical inner or internal toothing or teeth, which hollow body possesses an at least partial web portion or dish base and a tubular rim portion or dish rim connected to the web portion or dish base, as present in the case of an internal geared wheel or gear of a planetary gear system, comprises the steps of cold forming or cold working, according to the widely known Grob method or process, the rim portion or dish rim of the blank of the workpiece on a mandrel which possesses an outer or external toothing or teeth corresponding to the inner . or internal toothing or teeth to be fabricated at the substantially dished or pot-shaped hollow body.

In order to avoid any misunderstandings from the outset, the widely known Grob method of cold forming or cold working will be briefly elucidated hereinafter, even though this method is well known in this particular technology or art from documentation as well as from practice:

In the Swiss publication which is entitled "Industrie-Anzeiger", 95 (1973), No. 20, Page 393, there is disclosed that the Grob process can be used to produce relatively thin-walled, tubular parts which are equipped with similar toothings or teeth on the inside and the outside.

A special development of the Grob method which permits the fabrication of relatively thick-walled workpieces is disclosed in Swiss Patent No. 579,427, in French Patent No. 7,538,539 and in the German Patent No. 2,549,230, to which reference may be readily had and the disclosure of which is incorporated herein by reference. With these methods, different toothings or gear tooth systems can be fabricated on the inside and the outside of the workpiece.

In both of the above cases, an outer or external toothing or teeth and an inner or internal toothing or teeth are simultaneously fabricated by cold forming or cold working. The tubular workpiece is mounted on a suitable mandrel or plug. This mandrel has an outer or external toothing or teeth which corresponds to the inner or internal toothing or teeth of the workpiece which is to be fabricated. The workpiece mounted on the appropriate mandrel has imparted thereto an axial feed by axially moving and rotating the workpiece about its lengthwise axis. During the workpiece feed, the workpiece is externally worked by annular or ring-like profiled forming rolls or rolling tools (shaped in conformity with the outer or external toothing or teeth), whereby each forming roll or rolling tool performs single or individual blow-like or impacting forming operations in rapid succession or sequence. The site of application or locality of these single or individual blow-like or impacting forming operations performed at the workpiece is synchronized with or accommodated to the pitch of the toothing or teeth and the feed of the workpiece. These single blow-like or impacting forming operations are carried out in the same sense of direction and predominately in the lengthwise direction of the toothing or teeth. The single or individual blow-like impacting or forming operations consecutively carried out by the same forming roll or rolling tool lie in a helical or screw-like zone. This helical or screw-like zone is determined by the feed of the workpiece. Seen in the lengthwise direction of the toothing or teeth, the individual, consecutive blow-like or impacting forming operations in the same tooth gap or space partially overlap each other as concerns their point of application at the workpiece. During each single blow-like or impacting forming operation, material is pushed along a relatively small section of the workpiece into one of the depressions of the mandrel, mainly flowing in a radial direction.

Even in the case of the Grob method, a good shaping or forming of the inner or internal toothing or teeth is sometimes a problem, particularly with relatively thick-walled products, and substantially dished or pot-shaped or dish-like hollow bodies are particularly difficult to handle.

Also significant to the Grob method or process is German Patent No., 1,016,222, published Sept. 26, 1957, the disclosure of which is incorporated herein by reference.

SUMMARY OF THE INVENTION

Therefore, with the foregoing in mind, it is a primary object of the present invention to provide a new and improved method for fabricating a substantially dished or pot-shaped hollow body possessing substantially straight or helical inner or internal toothing or teeth and which does not exhibit the aforementioned drawbacks and shortcomings of the prior art techniques.

Another and more specific object of the present invention aims at providing a new and improved method for fabricating a substantially dished or pot-shaped hollow body possessing substantially straight or helical inner or internal toothing or teeth, which does not exhibit the previously discussed disadvantages and which improves the Grob method such that cleanly and accurately shaped or formed inner or internal toothing or teeth can be reliably fabricated even for substantially dished or pot-shaped hollow bodies which are suitable for use in planetary gear systems.

Now in order to implement these and still further objects of the invention, which will become more readily apparent as the description proceeds, the method of the present invention is manifested by the features that the blank of the workpiece, as seen or viewed in longitudinal section, possesses a substantially rounded or arcuate portion in the transition region between the rim portion or dish rim and the web portion or dish base, which substantially rounded or arcuate portion has a mean or median radius of curvature which is at least the same size as the predeterminate wall thickness of the rim portion or dish rim of the blank.

When certain criteria for the blank are adhered to, the inventive method allows for not only a better and more accurate shaping or forming of the inner or internal toothing or teeth up to the proximity or neighborhood of the web portion or dish base, but furthermore, this improvement can be achieved without an increased expenditure in force and with a good shaping or forming of the transition region.

The clean and accurate shaping of the inner or internal toothing or teeth or gear tooth system right up to the proximity of the web portion or dish base, makes possible the fabrication in one working operation of substantially straight and helical toothing or teeth with essentially proper or correct gear or gear wheel characteristics, for example, internal geared wheels or gears for planetary gear systems.

It is particularly advantageous when the aforementioned mean or median radius of curvature is at least the same size as half the difference between the outer or external diameter of the blank and the outer or external diameter of the mandrel.

According to the invention, only inner or internal toothings or teeth can be fabricated. The outer or external surface of the rim portion or dish rim is then constructed to be more or less smooth. This has the advantage that the position and number of the single or individual blow-like cold forming or impacting forming operations need only be synchronized with or accommodated to the feed of the workpiece to the extent that the inner or internal toothing or teeth is cleanly or accurately constructed. There is also achieved, a large production rate or quantity with high quality.

However, an outer or external profile can also be fabricated in the same working operation and this need not only be a toothing or gear tooth system. This outer or external profile can correspond to or deviate from the inner or internal toothing or teeth in pitch and direction.

It is advantageous when the single or individual blow-like cold forming or impacting forming operations are accomplished in a known manner such that they simultaneously act upon the workpiece from opposite sides. This enables the workpiece to be centered without the need for complex measures. Considerable subsequent machining or working of the product can be avoided when the axial flow of the material of the workpiece in the region of the edge of the rim portion or dish rim and/or externally in the transition region between the rim portion or dish rim and the web portion or dish base can be at least largely prevented by clamping limiting or boundary members to the workpiece. These limiting or boundary members have an outer or external diameter which is greater than the outer or external diameter of the mandrel but at most is the same size as the outer or external diameter of the product, that is, the hollow body to be fabricated.

Thus, one of these edge regions can be largely cleanly and smoothly constructed, so that only a very thin metal layer is axially projecting. This thin metal layer can be easily removed, for example, by means of a revolving knife or the like.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
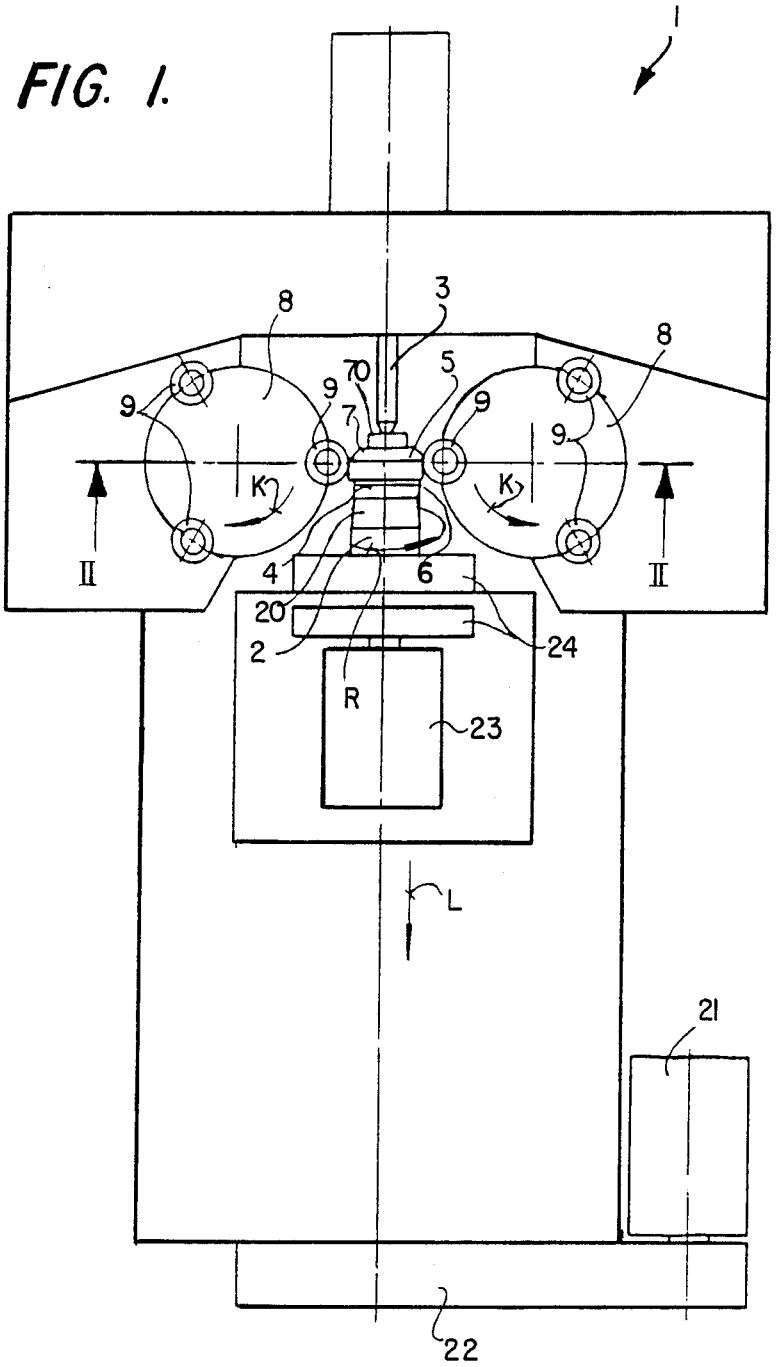
FIG. 1 is a plan view of an apparatus for carrying out the Grob method, showing the set-up of the apparatus shortly before the end of blow-like cold forming or impacting forming operations on an internal gear or internal gear tooth system.

Describing now the drawings, it is to be understood that to simplify the showing thereof only enough of the structure of the apparatus for carrying out the inventive method has been illustrated therein as is needed to enable one skilled in the art to readily understand the underlying principles and concepts of the present invention. Turning specifically now to FIG. 1 of the drawings, the apparatus 1 for carrying out the well known and aforedescribed Grob method possesses a programmably moved spindle 2 with tool support 20, and this movable spindle 2 is movable in a longitudinal direction in the direction of the arrow L and rotatable in the direction of the arrow R.

The linear, longitudinal drive of the spindle 2 is effected by means of the drive motor 21 over a transmission 22, while the rotational drive is derived from a drive motor 23 over a transmission 24. The drive motors 21 and 23 can be controlled in a known, suitable way by any suitable and therefore not particularly illustrated mechanical or electrical means and, if need be, synchronized with the roll drive (FIG. 2).

A center or tip holder 3 is operatively associated as a counter holder to the spindle 2.

Figure 3:
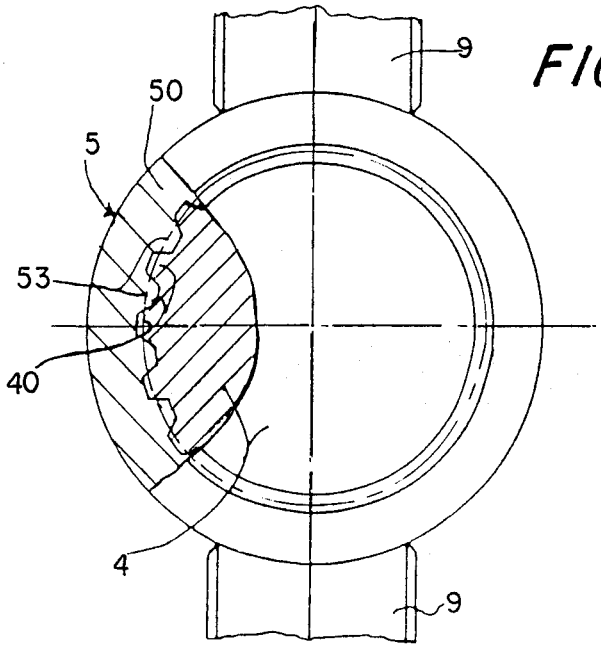
FIG. 3 is a further enlarged detail of the showing of in FIG. 2.
Figure 4:
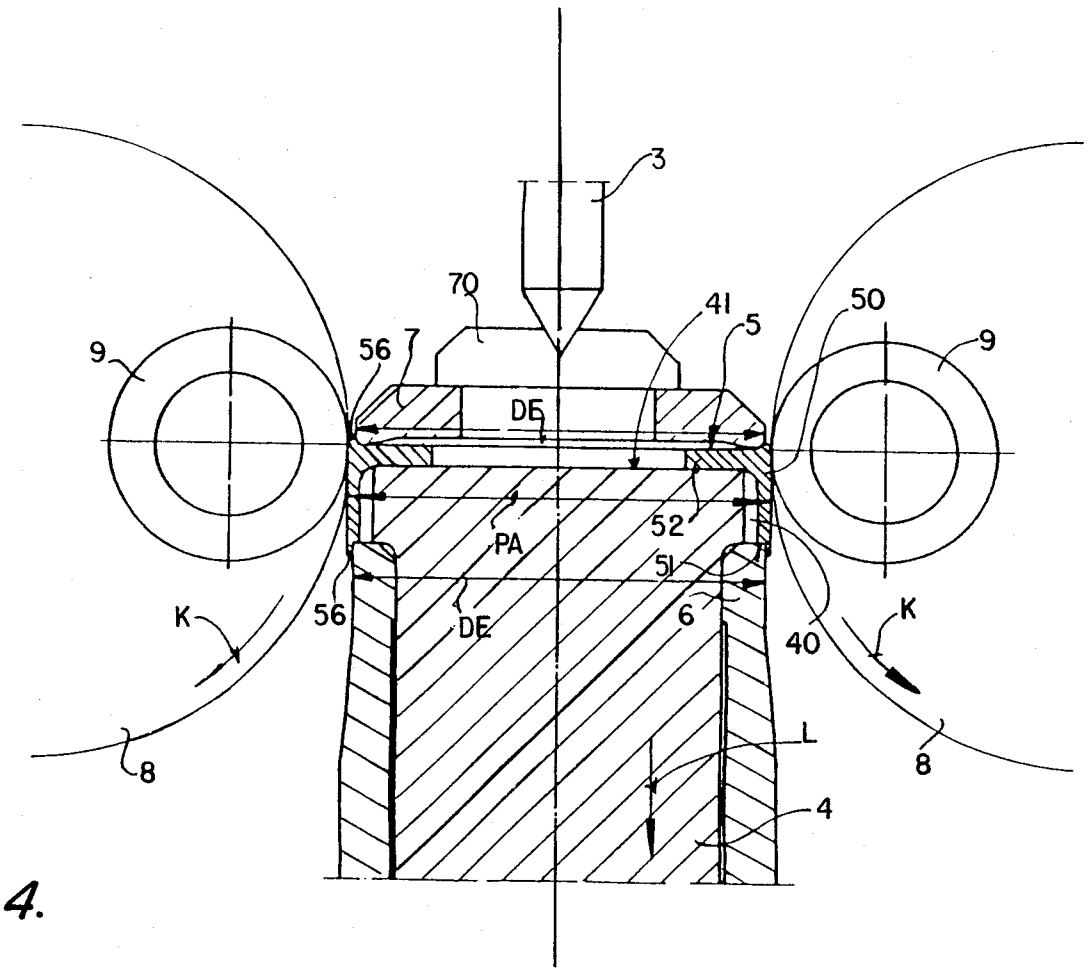
FIG. 4 shows an enlarged longitudinal section through the internal gear or internal gear tooth system in the process of being finish rolled, the associated mandrel, the two end holders, a center holder and schematic representations of the forming rolls or rolling tools.

As will be recognized by referring to FIGS. 1, 3 and 4, a mandrel 4 possessing an outer or external toothing or teeth or external gear tooth system 40 is fastened in the tool support 20. The blank of a workpiece 5 is mounted on the mandrel 4 such that the edge 51 of the rim portion or dish rim 50 rests against the end holder 6, while the inner or internal side of the web portion or dish base 52 rests against the end 41 of the mandrel 4. In addition, the web portion or dish base 52 is externally clampingly fastened by the end holder 7. The end holder 7 is, in turn, supported from the center or tip holder 3 by means of a centering piece or element 70.

Figure 2:
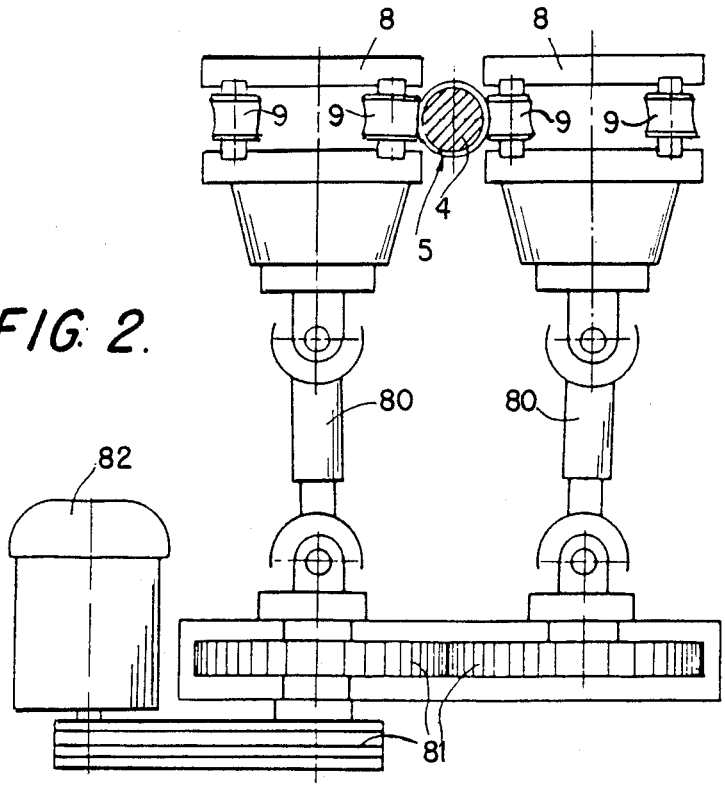
FIG. 2 is an enlarged section taken substantially along the line II—II in FIG. 1 and which serves only as an exemplary demonstration of the drive relationships or conditions prevailing when practicing the Grob method.

In FIGS. 1 to 4, almost finish rolled workpieces 5 are illustrated. In FIG. 2, the toothing or teeth has been omitted from the showing for reasons of clarity and simplification of illustration.

Figure 5:
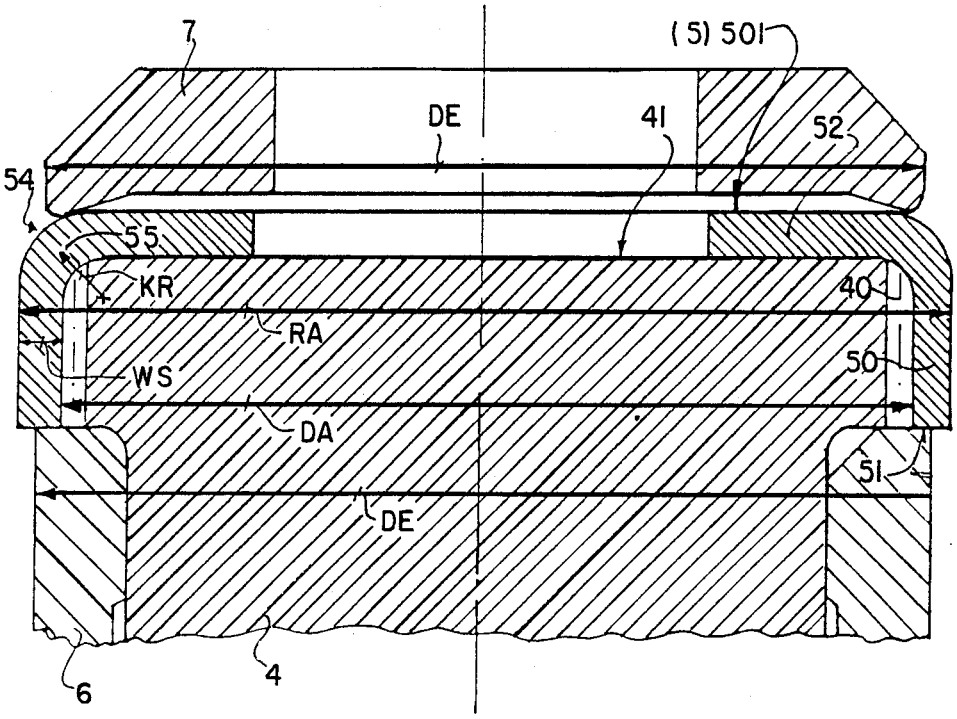
FIG. 5 shows a detailed section, comparable to the showing of FIG. 4, but on a still further enlarged scale and depicting only the mandrel, the two end holders and the blank mounted on the mandrel.

FIG. 5 shows the blank 501 of the workpiece 5.

The tool or roll heads 8 rotatingly driven in the direction of the arrows K carry cold forming tools or rolls 9 which are rotatably mounted in the tool or roll heads 8 and are drivable in a known manner. Two cold forming tools or rolls 9 always simultaneously act upon the workpiece 5 from opposite sides, so that the workpiece 5 is stabley supported even during the cold forming or working operation.

The tool or tool heads 8 are synchronously drivable by the drive motor 82 by means of suitable drive or Cardan shafts 80 and a transmission or gear train 81 (FIG. 2). If need be, the speed of rotation of the drive motor 82 can be synchronized with the speed of rotation of the drive motors 21 and 23. However, this is not necessary in this case because no outer or external toothing or teeth is to be rolled.

The outer or external toothing or teeth or gear tooth system 40 of the mandrel 4 visible in FIGS. 3 to 5, corresponds to the inner or internal toothing or teeth or gear tooth system 53 of the workpiece 5.

In FIG. 5 it can be clearly seen that the mean or median radius of curvature KR of the rounded or arcuate portion 55 in the transition region 54 between the rim portion or dish rim 50 and the web portion or dish base 52 of the blank 501 of the workpiece 5 is greater than the wall thickness WS of the rim portion or dish rim 50 of the blank 501 of the workpiece 5; this radius of curvature KR is even greater than half the difference between the outer or external diameter RA of the blank 501 of the workpiece 5 and the outer or external diameter DA of the mandrel 4, by means of which the (here only small) play between the inner or internal side or surface of the blank 501 of the workpiece 5 and the mandrel 4 is given adequate consideration.

In addition to the advantage of improved shaping or forming of the inner or internal toothing or teeth, particularly in the proximity of the web portion or dish base 52, a further advantage is realized in that this improvement is reached without a greater expenditure in force. According to the previous methods, much greater forces would have to be employed in order to obtain even approximately as good a toothing or teeth formation or construction, and the use of such large forces can damage the transition region.

In order to reduce the axial off-flow of material to an absolute minimum, the outer or external diameter DE of the end holders 6 and 7 is dimensioned to be at the maximum as large as and may even be a little smaller than the outer or external diameter PA of the finished workpiece 5, but clearly greater than the outer or external diameter DA of the mandrel 4 (see FIGS. 4 and 5). There are thus produced, only very thin flow beads 56 which, for reasons of clarity, are drawn on an exaggerated scale or flash-like protuberances in FIG. 4. These thin flow beads 56 can be simply removed, for example, with the aid of a revolving knife or equivalent structure. This can be performed directly after rolling, so that a stripping or post-machining of the product is no longer necessary.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method for fabricating a substantiallly dished hollow body possessing straight or helical internal teeth, having at least a partial web portion and a substantially tubular rim portion connected to said web portion, comprising the steps of:

providing a workpiece blank which, in longitudinal section, possesses a rounded portion in a transition region between a rim porion, having a predetermined wall thickness, and a web portion thereof;

forming said rounded portion with a mean radius of curvature which is at least as large as the predetermined wall thickness of said rim portion of said workpiece blank;

providing a mandrel which possesses external teeth corresponding to said internal teeth which are to be fabricated on the workpiece blank; and cold working said rim portion of the workpiece blank on the mandrel according to the Grob method to form the substantially dished hollow body with internal teeth up to the proximity of said web portion of said workpiece blank.

2. The method as defined in claim 1, wherein: the workpiece blank has an outer diameter;

the mandrel has an outer diameter; and selecting said mean radius of curvature of said rounded portion such that it has at least the same size as half the difference between the outer diameter of said workpiece blank and the outer diameter of said mandrel.

3. The method as defined in claim 1, further including the step of:

only producing internal teeth on the workpiece blank.

4. The method as defined in claim 3, wherein:

said cold working of said rim portion of the workpiece blank on the mandrel according to the Grob method to form the substantially dished hollow body with the internal teeth entails applying individual blow-like forming operations during a predeterminate feed of the workpiece up to the proximity of said web portion of said workpiece blank and synchronizing the individual blow-like forming operations with the predeterminate feed of the workpiece blank only to the extent necessary to produce substantially well-shaped internal teeth.

5. The method as defined in claim 3, further including the step of:

producing at least an approximately smooth outer surface of said workpiece blank.

6. The method as defined in claim 1, further including the steps of:

producing substantially simultaneously with the production of said internal teeth on the workpiece blank an external profile.

7. The method as defined in claim 1, wherein:

said cold working of said rim portion of the workpiece blank on the mandrel according to the Grob method to form the substantially dished hollow body with the internal teeth entails applying individual blow-like forming operations during the feeding of the workpiece blank up to the proximity of said web portion of said workpiece blank; and carrying out said individual blow-like forming operations such that said individual blow-like forming operations act from opposite sides simultaneously on said substantially dished hollow body.

8. The method as defined in claim 1, further including the steps of:

axially clamping boundary members to said workpiece blank to at least largely prevent axial flow of material of said workpiece blank in at least the region of an associated edge of said rim portion; and said boundary members having an outer diameter which is greater than an outer diameter of said mandrel but at the maximum as large as an outer diameter of said substantially dished hollow body.

9. The method as defined in claim 1, further including the steps of:

axially clamping boundary members to said workpiece blank to at least largely prevent axial flow of material of said workpiece blank at least externally in the transition region between said rim portion and said web portion; and said boundary members having an outer diameter which is greater than an outer diameter of said mandrel but at the maximum as large as an outer diameter of said substantially dished hollow body.

10. The method as defined in claim 1, further including the steps of:

axially clamping boundary members to said workpiece blank to at least largely prevent axial flow of the material of said workpiece blank in the region of an edge of said rim portion and externally in the transition region between said rim portion and said web portion; and said boundary members have an outer diameter which is greater than an outer diameter of said mandrel but at the maximum as large as an outer diameter of said substantially dished hollow body.

11. A method for fabricating a substantially dished hollow body possessing internal teeth, a dish base and a substantially tubular dish rim connected to said dish base, comprising the steps of:

providing a workpiece blank which, in longitudinal section, possesses an arcuate portion in a transition region between a substantially tubular dish rim having a predetermined wall thickness and a dish base thereof;

forming said arcuate portion with a mean radius of curvature which is at least as large as the predetermined wall thickness of said substantially tubular dish rim of said workpiece blank;

providing a mandrel which possesses external teeth corresponding to said internal teeth which are to be fabricated on the workpiece blank; and cold forming said substantially tubular dish rim of the workpiece blank on the mandrel to form the substantially dished hollow body with internal teeth up to the proximity of said dish base of said workpiece blank.

* * * * *